United States Patent [19]

Wysocki

[11] 4,389,834

[45] Jun. 28, 1983

[54] LOOSE PRODUCT BAGGING AND BALING SYSTEM

[76] Inventor: Gregory E. Wysocki, Rte. 1, Custer, Wis. 54423

[21] Appl. No.: 245,210

[22] Filed: Mar. 18, 1981

[51] Int. Cl.[3] ..... B65B 5/10; B65B 39/14

[52] U.S. Cl. ..... 53/475; 53/391; 53/570; 53/251; 248/100

[58] Field of Search ..... 53/391, 390, 570, 572, 53/475, 473, 469, 251, 235; 248/99, 100

[56] References Cited

U.S. PATENT DOCUMENTS

| | | | |
|---|---|---|---|
| 1,124,459 | 1/1915 | King et al. | 248/99 |
| 1,580,163 | 4/1926 | Peterson et al. | 248/100 X |
| 2,234,951 | 3/1941 | Belcher | 53/570 |
| 3,028,713 | 4/1962 | Kennedy et al. | 53/251 |
| 3,045,720 | 7/1962 | Jungmayr et al. | 53/251 X |
| 3,112,777 | 12/1963 | Lohse | 53/570 X |
| 3,621,629 | 11/1971 | Wickersheim | 53/570 X |
| 3,698,155 | 10/1972 | Robinson | 53/390 |
| 4,137,689 | 2/1979 | McClusky et al. | 53/570 X |

*Primary Examiner*—Horace M. Culver

*Attorney, Agent, or Firm*—Harvey B. Jacobson

[57] ABSTRACT

A rotary horizontal table is provided and has item delivery structure associated therewith for supplying items to be packaged to the table and a plurality of stationary worker positions are disposed about the table slightly outwardly of the periphery thereof. Rotary container support structure spaced apart in a generally circular path substantially concentric with the axis of rotation of the table is also provided and supported for simultaneous angular displacement about the table with the support structure substantially registered with the outer periphery of the table. Workpersons disposed at the worker positions may manually transfer items from the table to containers supported from the container support structure and first drive structure is operatively connected to the table for rotating the latter while second drive structure is operably connected to the container support structure for angularly displacing the latter. The first and second drive structures are such that the rotational speeds of the table and the container support structure may be independently varied.

8 Claims, 8 Drawing Figures

LOOSE PRODUCT BAGGING AND BALING SYSTEM

BACKGROUND OF THE INVENTION

Various forms of automatic article bagging and baling machines heretofore have been provided as well as semiautomatic bagging and baling machines. However, most of these previously known forms of machines are constructed in a manner such that their usage must follow a method of bagging or baling which results in bagging or baling rates, accomplished by a given number of workmen, which are considerably slower than desirable. Accordingly, with the recent increase cost of labor and in consideration of the expected future increase in cost of labor, a need exists for a bagging and/or baling machine which will be capable of performing a bagging or baling operation of the highest possible rate for a given number of workpersons.

Examples of previously known forms of bagging and baling machines including some of the general structural and operational features of the instant invention are disclosed in U.S. Pat. Nos. 1,124,495, 1,555,360, 2,455,433, 2,624,539, 3,100,569 and 3,406,727.

BRIEF DESCRIPTION OF THE INVENTION

The bagging and baling machine of the instant invention includes a rotary table onto which items or articles to be bagged or baled are deposited at a substantially constant rate and the table is rotatable, at variable speeds. Container support structures spaced apart in a generally circular path substantially concentric with the axis of rotation of the table are provided and supported for simultaneous angular displacement about the table with the support means substantially registered with the outer periphery of the table. The machine has stationary workpersons' stations disposed thereabout from which persons may manually transfer items from the table to containers supported from the container support structure and drive structure is drivingly coupled to the support structure for rotating the latter, also at variable speeds, about the axis of rotation of the table. The workpersons' stations disposed about the table include successive stations in the direction of rotation of the container support structure including a container hanging station, a plurality of container filling stations and a container drop-off station. The last container filling station in the direction of rotation of the container support structure includes controls whereby the speed of rotation of the table and the container support structure may be varied as desired.

The main object of this invention is to provide an apparatus wherein individual bags of articles may be efficiently placed in large bale containers for shipment of bulk quantites of the articles.

Another object of this invention is to provide a machine whereby a few workpersons may establish a high production rate of large bale containers each filled with a quantity of bags containing individual articles.

Another very important object of the invention is to provide an apparatus for semiautomatic filling of large bale containers and whose operating speed may be adjusted according to the ability and the number of workpersons working in conjunction with the apparatus.

A final object of this invention to be specifically enumerated herein is to provide a semiautomatic bagging and baling system in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully herein described and claimed, reference being had to the accompanying drawings forming a part hereof, wherein like numerals refer to like parts throughout.

DETAILED DESCRIPTION OF THE INVENTION

Figure 1:
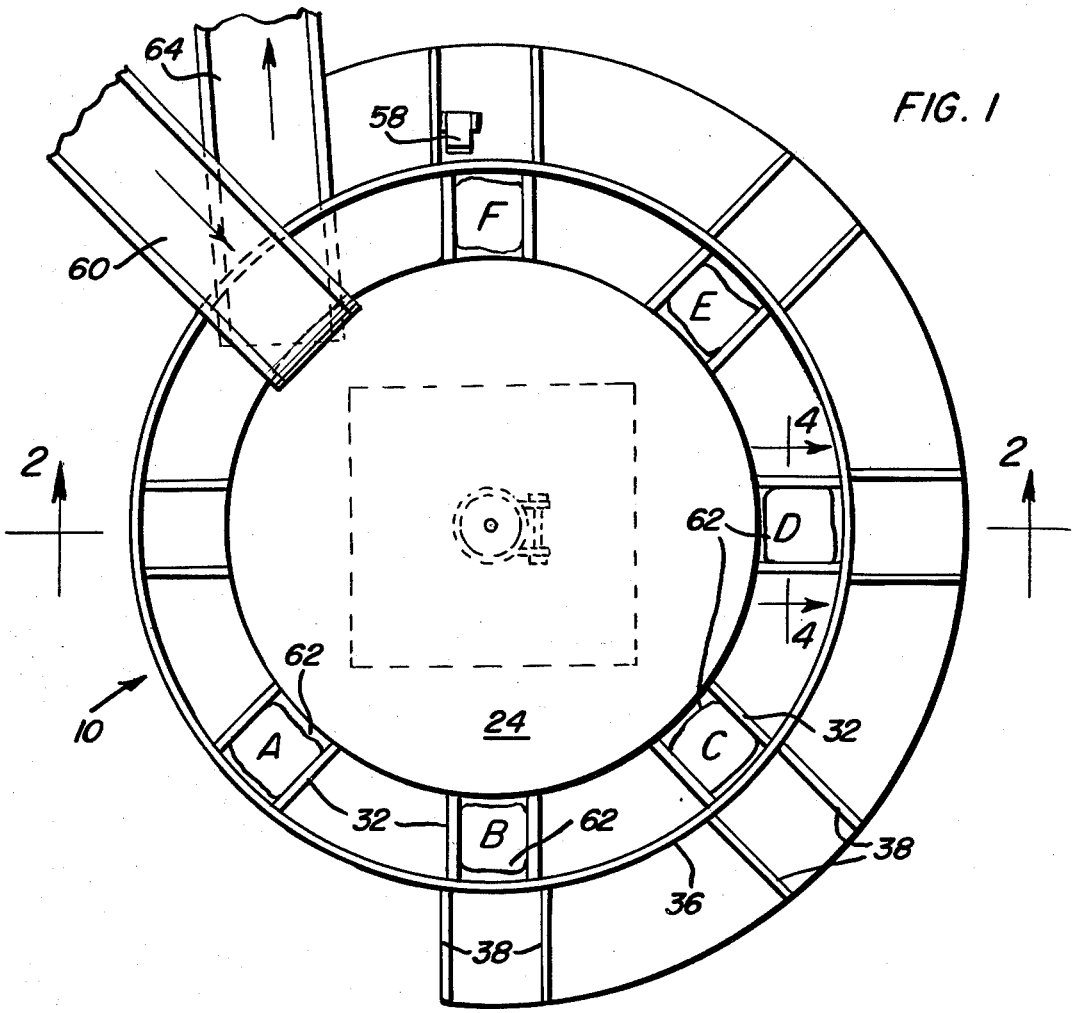
FIG. 1 is a top plan view of the system of the instant invention.
Figure 4:
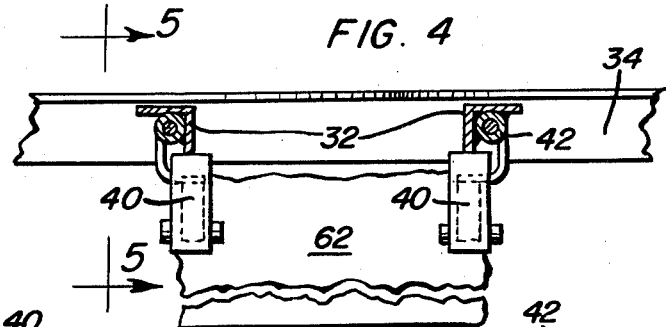
FIG. 4 is a fragmentary enlarged vertical sectional view taken substantially upon the plane indicated by the section line 4—4 of FIG. 1.
Figure 5:
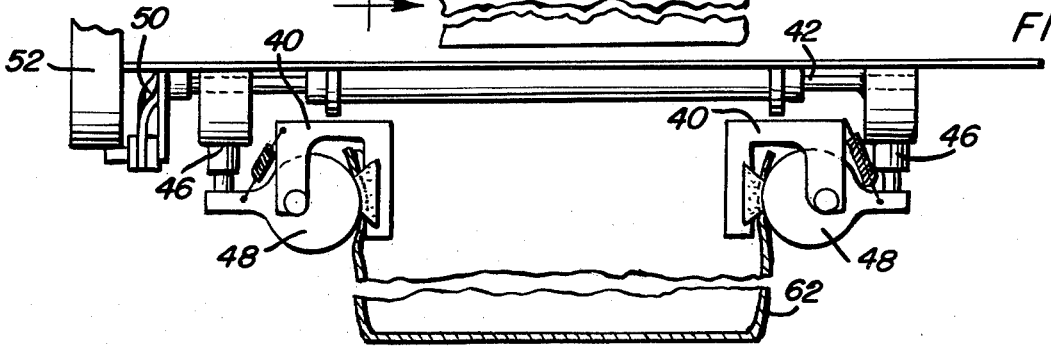
FIG. 5 is a fragmentary vertical sectional view taken substantially upon the plane indicated by the section line 5—5 of FIG. 4 and illustrating the manner in which the bale-type containers may be automatically released at the bale drop station.
Figure 2:
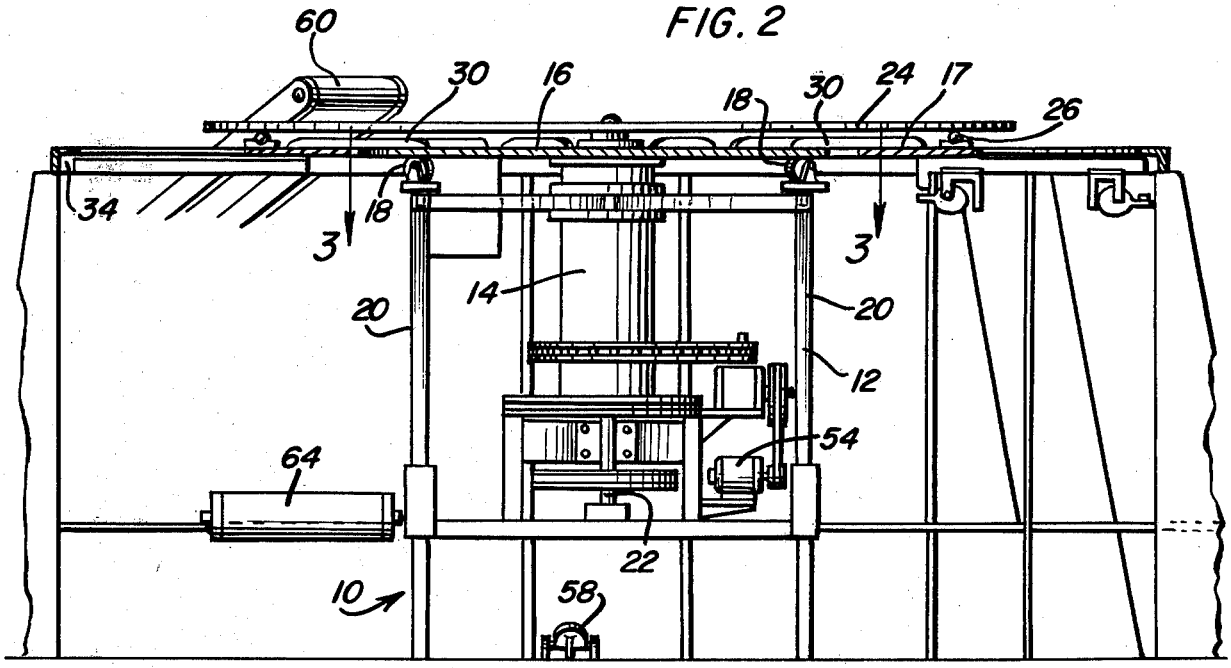
FIG. 2 is an enlarged vertical sectional view taken substantially upon the plane indicated by the section line 2—2 of FIG. 1.
Figure 3:
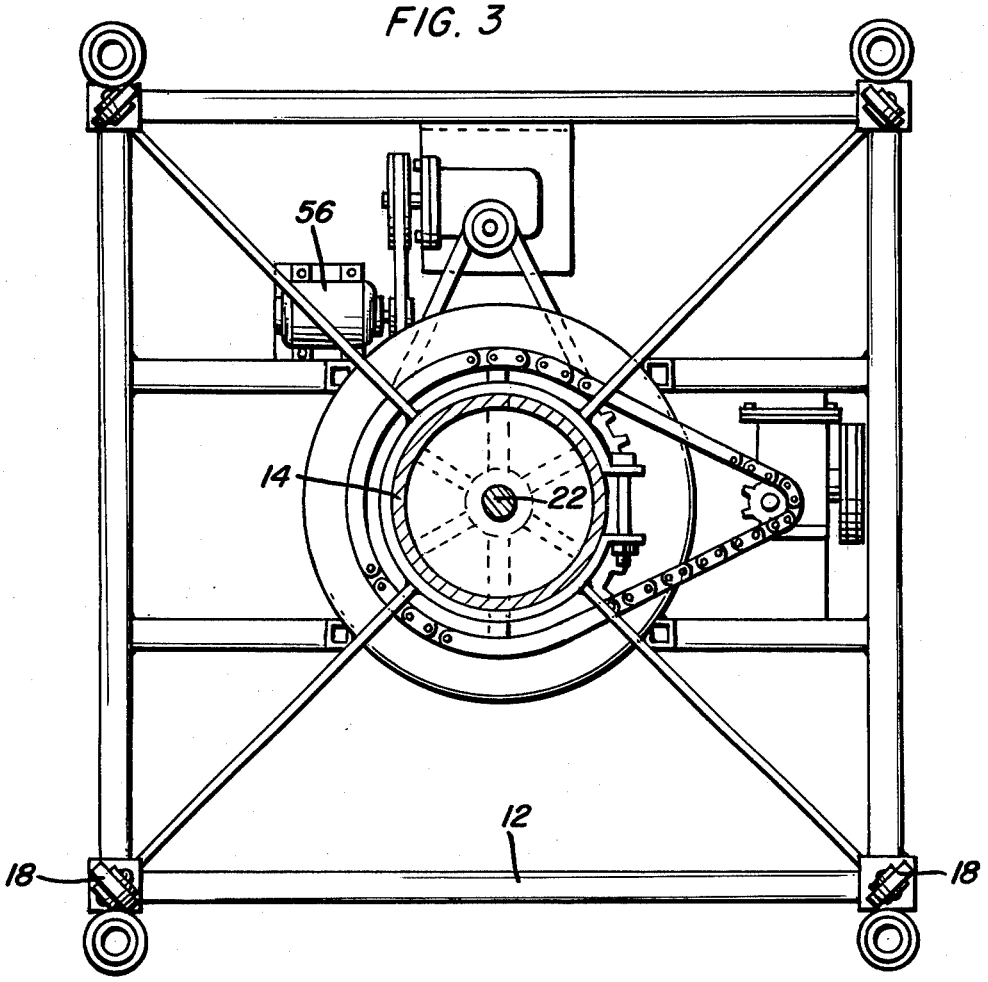
FIG. 3 is an enlarged horizontal sectional view taken substantially upon the plane indicated by section line 3—3 of FIG. 2.
Figure 6:
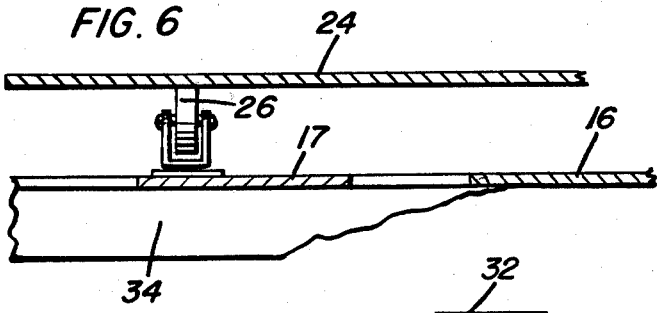
FIG. 6 is a fragmentary vertical sectional view illustrating the manner in which the outer periphery of the upper table is rollingly supported from the outer peripheral portion of the underlying rotary container support structure.
Figure 7:
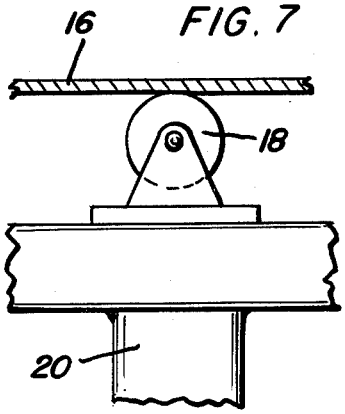
FIG. 7 is a fragmentary vertical sectional view illustrating the manner in which the rotary container support structure is rollingly supported from the upper ends of four corner posts.
Figure 8:
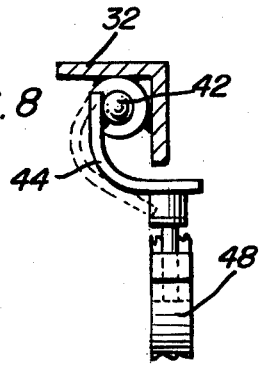
FIG. 8 is a fragmentary vertical sectional view illustrating the manner in which bales supported from the bale support structure may be automatically dropped therefrom.

Referring now more specifically to the drawings, the numeral 10 generally designates the machine of the instant invention. The machine 10 includes main frame structure 12 from which an upstanding tubular support member 14 is rotatably journaled. The support member 14 includes an upper horizontal plate portion 16 including an outer annular portion 17 whose undersurface rollingly engages a plurality of support wheel 18 journaled from the upper ends of four uprights 20.

An upstanding shaft 22 is also journaled from the main frame 12 and extends upwardly through the support member 14 and the central portion of an upper horizontal table 24 is secured to the upper end of the shaft 22. The outer peripheral portions of the table 24 are rollingly supported from underlying support wheels 26 carried by the outer annular portion 17 and the latter is supported from the plate portion 16 through the utilization of connecting arms 30.

The outer annular portion 17 includes eight pairs of peripherally spaced, parallel and generally radially outwardly projecting support arms 32 supported therefrom and the outer ends of the support arms are received, in closely spaced relation, within the included angle area 34 defined by an outer guard rail 36 stationarily supported outwardly of and extending about the table 24. The guard rail 36 is supported from suitable pairs of supports 38 spaced about the machine 10 and defining workpersons' stations therebetween.

Each of the support arms 32 includes a pair of clamp assemblies 40 supported therefrom and each pair of clamp assemblies 40 is under the control of an oscillatable operating shaft 42 journaled from the corresponding support arm 32 and including opposite end lever arms 44 supported therefrom engageable with downwardly displaceable plungers 46 for releasing spring biased oscillatable cam latches 48 of the corresponding clamp assemblies 40. The operating shafts 42 each include inner ends having an operating lever 50 mounted thereon engageable with a stationary cam-type abutment 52 mounted on the main frame 12.

The support member 14 is driven by a variable speed electric motor 54 and the shaft 22 is driven by a variable speed electric motor 56. The electric motor 56 may be provided with any suitable variable speed control for controlling the speed of rotation of the table 24 and the electric motor 54 is provided with a foot actuated variable speed control 58 for use by a control workperson.

A supply conveyor 60 is provided for conveying bags of items or articles to be baled to the table 24 and the bags of items or articles are discharged from the conveyor 60 directly onto the table 24. In addition, the cam-type abutment 52 is disposed in an area underlying the discharge end of the supply conveyor 60 and is operable to release the clamp assemblies 40 from supportive engagement with the bale forming containers 62 as the containers 62 swing into vertical alignment with the input end of a discharge conveyor 64 for conveying the filled containers 62 away from the machine 10.

A first container hanging station is designated at A and as the support arms 32 swing past the station A a workperson hangs the containers 62 from the corresponding clamp assemblies 40. The next five stations in the direction of rotation of the table 24 comprises stations B, C, D, E and F and at each of the stations B, C, D, E and F a workperson is positioned between the corresponding supports 38. These workpersons receive bags of articles, such as bags of potatoes, from the table 24 advanced toward them and each workperson will pick up two bags of potatoes and place these two bags into the container 62 disposed at his station. The support arms 32 are continuously swinging in a counterclockwise direction as viewed in FIG. 1 of the drawings and thus moving toward station F. As each container 62 passes one of the stations B, C, D, E and F, the workperson at that station places two bags in the corresponding container. Thus, when the containers 62 pass the station F, the last two of ten bags are placed within the containers 62. The angular displacement rate of the support arm 32 and thus the containers 62 is under the control of the workperson at station F. In addition, the workperson at station F may also be afforded the aforementioned variable speed control for the electric motor 56.

At station A cam-type abutments similar to the abutment 52 may also be provided to maintain the clamp levers 48 in position to enable the containers 62 to be more readily engaged with the clamp assemblies 40 and the clamp levers 48 may be automatically released during movement of a container 62 from the station A toward the station B.

It is to be noted that by proper speed control of the motor 54, the support arms 32 may swing at an angular speed providing just enough time for each workperson at stations B, C, D, E and F to take two bags of articles from the table 24 and place those two bags into the adjacent container 62 just prior to that container moving into the area of the next adjacent station.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A loose product bagging and baling machine including a rotary horizontal table, item delivery means for discharging items on said table, a plurality of stationary worker positions spaced slightly outwardly of and about the periphery of said table, rotary container support means spaced apart in a generally circular path substantially concentric with the axis of rotation of said table and supported for simultaneous angular displacement thereabout with said support means substantially registered with the outer periphery of said table, whereby persons positioned at said worker positions may manually transfer items from said table and place the items being transferred into containers supported from said support means, and first drive means operatively connected to said table for rotating the latter and second drive means operably connected to said container support means for angularly displacing the latter.

2. The combination of claim 1 wherein said first drive means includes means for selectively varying the speed of rotation of said table.

3. The combination of claim 1 wherein said second drive means includes means operative to selectively vary the speed of rotation of said container support means.

4. The combination of claim 1 wherein said first drive means includes means for selectively varying the speed of rotation of said table.

5. The combination of claim 1 wherein said workpersons' stations include successively, in the direction of rotation of said container support means, a container hanging station, a plurality of container filling stations and a container drop-off station.

6. The combination of claim 5 wherein said container drop-off station includes means operative to automatically release sucessive containers advanced theretoward from said container support means for movement of said containers, filled, away from said machine.

7. The combination of claim 6 wherein the last container filling station, in the direction of rotation of said table, has said means operative to selectively vary the speed of rotation of said container support means mounted for ease of operation of the workperson disposed at said last container filling station.

8. The method of rapid filling a plurality of containers with a plurality of items through the use of minimum manual labor, said method comprising:

(A) establishing a plurality of worker stations in spaced relation along a first predetermined path;

(B) providing a replenishing supply of a plurality of items to be placed in said containers and moving said containers along a second path substantially paralleling said first path;

(C) providing and moving a replenishing supply of spaced apart containers to be filled with said items along a third path substantially paralleling said first path and disposed between the latter and the second path; and (D) manually transferring at least one item from said first path into the container at each worker's station as successive containers register with said worker's stations and with the number of stations multiplied by the number of items transferred at each station equalling the total number of items to be transferred from the first path to each container.

* * * * *